US005465881A

United States Patent [19]

Zwicky

[11] Patent Number: 5,465,881

[45] Date of Patent: Nov. 14, 1995

[54] SYSTEM FOR UNDERWATER REPAIR OF CRACKS IN CONCRETE

[76] Inventor: Ron A. Zwicky, 5006 E. Lakeside, Orange, Calif. 92667

[21] Appl. No.: 146,399

[22] Filed: Nov. 1, 1993

[51] Int. Cl.[6] ..... B67D 5/42

[52] U.S. Cl. ..... 222/389

[58] Field of Search ..... 222/389

[56] References Cited

U.S. PATENT DOCUMENTS

| | | | |
|---|---|---|---|
| 1,042,627 | 10/1912 | Watson | 222/389 |
| 1,382,397 | 6/1921 | Whitehouse | 222/389 |
| 2,446,501 | 8/1948 | Weber | 222/389 |
| 3,138,303 | 6/1964 | Hoveland | 222/389 |
| 3,221,947 | 12/1965 | Penn | 222/389 X |
| 3,237,814 | 3/1966 | Collar | 222/389 X |
| 3,321,110 | 5/1967 | Price | 222/389 |
| 4,634,027 | 1/1987 | Kanarvogel | 222/389 X |

*Primary Examiner*—Kevin P. Shaver
*Attorney, Agent, or Firm*—Charles H. Thomas

[57] ABSTRACT

A hardenable sealant composition, apparatus for application, and method of implementation are provided for repairing cracks in concrete covered by water. The apparatus of the invention employs a sealant reservoir formed with a high pressure cylinder having twistlock ends. The cylinder is filled with a cement compound that will subsequently harden under water. The cylinder contains a piston and is coupled at one end to a high pressure pneumatic hose. The other end of the cylinder is connected to a material delivery hose which in turn leads through a manually operable metering valve assembly to a hollow injection needle. Holes are drilled into the surface of an underwater concrete structure in which a crack appears, and the injection needle is inserted into the holes, one by one. The sealant composition is formed of a resin, a resin hardener, white cement and underwater cement. It is extruded from the sealant reservoir under the control of the metering valve. As the sealant is expelled from the needle in each hole it enters and permeates the crack throughout the length and depth of the crack. If the viscosity of the sealant composition to be extruded into the cracks warrants, surface sealant may be applied along the length of the crack before injection of the sealant into the holes to prevent the injected sealant from emanating from the crack.

1 Claim, 3 Drawing Sheets

SYSTEM FOR UNDERWATER REPAIR OF CRACKS IN CONCRETE

BACKGROUND OF THE INVENTION

1. Field of the Invention

The present invention relates to a system, including a method, apparatus and sealant composition, for effectuating repairs underwater to cracks in concrete.

2. Description of The Prior Art

At present, swimming pools and other manmade structures designed to hold or confine large volummes of water are very often formed of concrete. Concrete has the distinct advantage of very high strength and resistance to compressive forces, impermeability to water, and is not subject to corrosion or degradation with time. For this reason concrete swimming pools, spas, flood channels, culverts and other structures have been utilized for many years to confine large volummes of water.

One problem which has occurred and which has persisted throughout the years in the use of concrete structures for confining or retaining water is that cracks can develop in the concrete. Such cracks sometimes occur as a result of seismic activity of the earth. However, underwater cracks in swimming pools, dams, flood control channels and other structures used to confine large volummes of water can develop not only as a result of earthquakes, but due to other causes as well. For example, such cracks can result from explosions in the vicinity, substantial changes in the level of the water confined, erosion or settling of soil beneath or adjacent to the structure, and as a result of a variety of other causes.

Cracks that develop in the floors and walls of swimming pools and other underwater concrete structures, can create severe problems. For example, water leaking from a swimming pool through cracks in its concrete structure can place a serious financial burden on the owner of the pool to replace the water lost, since large volumes of water can be wasted in this way. Furthermore, the leakage of water through the floor or wall of a swimming pool can soften the soil in which the pool is embedded and cause weakness in the support of the pool. Cracks also weaken the structural integrity of the pool structure itself. Similar problems result from cracks in other types of concrete structures that confine large quantities of water.

A variety of different conventional approaches have been attempted to seal cracks in underwater concrete structures. For example, bituminous or tar-like sealants have been employed for this purpose. However, although these types of sealants are largely insoluble in water, they cannot be forced deep into underwater cracks. Also, such conventional materials do not adequately bond to the adjacent surfaces of fractures in the concrete. At the most, such conventional sealants form only a surface patch over the crack. Water can seep in around conventional sealants and escape through the cracks in the concrete.

SUMMARY OF THE INVENTION

The present invention provides a system for sealing underwater cracks in concrete in a manner far superior to that heretofore achieved. The present invention is highly effective because it combines a unique apparatus for injecting a sealant underwater using a uniquely blended injection compound. The apparatus for delivering an underwater sealant composition is custom designed for use with the injection compound and is utilized according to a novel and unique procedure to perform repairs to underwater cracks in concrete which last far longer and are far more effective than conventional repair systems.

One broad aspect of the invention is an apparatus for delivering an underwater sealant composition. The apparatus of the invention is comprised of a sealant reservoir formed with a cylindrical barrel having open, opposing delivery and pressure application ends. The reservoir also includes a piston having opposite pressurized fluid and sealant composition end faces. The piston is disposed for reciprocal movement within the cylindrical barrel. A pressure application end plug is removably secured to the pressure application end of the barrel in fluid tight engagement therewith facing the pressurized fluid end of the piston. The pressure application end plug has a duct therethrough that conveys fluid under pressure into the barrel to bear against the pressure fluid end face of the piston. A sealant composition delivery end plug is also provided and is removably secured to the delivery end of the barrel in fluid tight engagement therewith. The sealant composition end plug has an extrusion orifice therein.

The apparatus of the invention is also comprised of a source of fluid under pressure coupled to provide fluid under pressure to the sealant reservoir through the pressure application end plug. A flexible delivery hose is also provided and has one end connected to the sealant composition delivery end plug and an opposite end. A manually operable metering valve is coupled to the opposite end of the delivery hose. A hollow injection needle is connected to the manually operable metering valve.

While hydraulic fluid can be employed, the fluid under pressure is preferably a pneumatic compressed air supply. The pneumatic compressed air supply may be utilized both to supply pneumatic pressure to the sealant reservoir, and also as a source of air for a diver performing the repair.

The sealant reservoir of the apparatus of the invention is designed to accommodate a charge of a hardenable, underwater sealant composition in a sealant composition cavity that is defined within the barrel between the sealant composition delivery end plug and the sealant composition end face of the piston. Because the composition required to create an effective repair in underwater cracks in concrete is subject to hardening, it is quite important for the apparatus of the invention to be capable of being thoroughly cleaned. For this reason the cylindrical barrel of the sealant reservoir preferably has camlock grooves defined at each of its opposite ends. The end plugs both have radially outwardly projecting camlock pins that are engageable in the camlock grooves to releasably secure the plugs to the barrel ends. The end plugs are provided with some means for tightening and untightening. Preferably, they are both provided with a pair of oppositely directed radially projecting torquing hand grips that can be seized by an operator. With the end plugs in the ends of the barrels, the hand grips can be turned in one direction to carry the camlock pins into full engagement in the camlock grooves to seal the end plugs in the barrel ends. The hand grips also allow the end plugs to be twisted in an opposite direction to allow the camlock pins to be aligned with the axial portions of the camlock grooves, whereupon the end plugs can be longitudinally withdrawn from the sealant reservoir barrel ends. With the end plugs withdrawn the sealant reservoir barrel can be thoroughly cleaned, as can the end plugs.

Preferably the outer wall of the barrel is externally threaded at both ends and annular internally threaded reinforcing sleeves are threadably engaged on the outer walls of the barrel at its opposite ends in longitudinal alignment with the camlock grooves. Since the camlock grooves in the barrel walls represent areas of weakness in the barrel, the reinforcing sleeves serve to radially reinforce the barrel externally thereabout at both of its ends.

Preferably also the piston is provided with an axial, tapped well in its pressurized fluid end face. This tapped well is adapted to receive an elongated extractor rod that is externally threaded on at least one end. The extractor rod is engageable in the tapped well of the piston to engage the piston for withdrawal from the barrel. Thus, both the end plugs and the piston are removed from the barrel to facilitate cleaning all parts of the sealant reservoir.

Another broad aspect of the invention resides in the underwater sealant composition utilized. The sealant composition of the invention is comprised of a first component formed of between about 800 and about 1200 parts by weight of an amine resin activator, between about 500 and about 1700 parts by weight white cement, and between about 1000 and about 3300 parts by weight of underwater cement. The underwater sealant composition also has a second component formed of between about 800 and 1200 parts by weight of an amine resin, between about 500 and 1600 parts by weight of white cement, and between about 1000 and 3000 parts by weight of underwater cement. The two components can be separately premixed and stored separately for many months. When the two components are mixed together, however, they will harden, typically in about an hour. The pot life is determined by the relative proportions of the constituents.

The underwater sealant composition of the invention is a unique material that employs epoxy resins, hardeners, underwater curing cements and fillers. The relative proportions of the sealant composition are varied depending upon the application. Specifically, the sealant composition is formulated to have a low viscosity for repairing cracks under 1/16 of an inch in width. For narrow cracks of this type a low viscosity sealant is necessary so that the sealant composition will seep through the crack throughout its length and depth to bond throughout to both adjacent surfaces of the concrete in which the crack is formed.

An underwater sealant composition formulated according to the invention to have a low viscosity is characterized in that the first and second components each have between about 500 and about 750 parts by weight white cement and between about 1000 and about 1500 parts by weight underwater cement. Preferably, the first component is formed with about 1000 parts by weight of an amine resin activator while the second component is formed with about 1000 parts by weight of amine resin. Each of the first and second components is preferably formed with about 625 parts by weight white cement and about 1250 parts by weight underwater cement. The ratio of the weight of the second component to that of the first component is preferably about 2:1.

When a low viscosity underwater sealant composition according to the invention is employed, the surface of the concrete in which the crack appears or is exposed is preferably first covered with a surface sealant along the crack. The surface sealant is formulated so as to have a relatively firm composition which can be molded by hand and spread in a strip along the surface of the concrete in which the concrete appears so as to span the crack. The surface sealant is applied as a relatively flat strip or layer of material that follows the line of the crack, which is typically quite irregular. The surface sealant forms a surface barrier that prevent the low viscosity sealant from being forced out of the crack and into the body of water when the low viscosity sealant composition is applied according to the method of the invention. The surface sealant confines the low viscosity sealant composition to the interior structure of the concrete, and forces it to follow the walls of the crack in the concrete throughout the entire length and depth of the crack.

When formulated as a surface sealant, the first component of the sealant composition of the invention has between about 1300 and about 1700 parts by white cement and between about 2700 and 3300 parts by weight underwater cement. The second component has between about 1200 and about 1600 parts by weight white cement and between about 2500 and about 3000 parts by weight underwater cement. In its preferred formulation the sealant composition formulated for use as a surface sealant has a first component formed with about 1000 parts by weight of an amine resin activator, about 1500 parts by weight white cement and about 2900 parts by weight underwater cement. The second component of the surface sealant composition is preferably formed with about 1000 parts by weight of an amine resin, about 1400 parts by weight white cement and about 2750 parts by weight underwater cement. The ratio of the weight of the second component to that of the first component is preferably in the range from about 1:1 and 2:1.

For cracks having a width greater than 1/16 of an inch the sealant composition of the invention should be formulated with a higher viscosity. According to this formulation the first component of the sealant composition has between about 1300 and about 1600 parts by weight white cement and between about 2700 and 3200 parts by weight underwater cement. The second component has between about 1200 and about 1500 parts by weight white cement and between about 2500 and about 3000 parts by weight underwater cement. A high viscosity sealant composition according to the invention for use in underwater concrete cracks having a width of about 1/16 of an inch and greater is preferably formulated so that the first component is formed with about 1000 parts by weight of an amine resin activator, about 1440 parts by weight white cement and about 2880 parts by weight underwater cement. The second component is formed with about 1000 parts by weight of an amine resin, about 1360 parts by weight white cement, and about 2720 parts by weight underwater cement.

The polyamide resin activator employed in the high and low viscosity sealant composition formulations of the invention may be a mixture of 10 to 25 percent polyamide or modified amine resin and 75 percent to 90 percent accelerated amine resin. Preferably the polyamide or modified amine resin forms about 1/6 of the resin activator, while the accelerated amine resin forms about 5/6 of the amine resin activator. The polyamide amine which is employed may, for example, be that sold commercially by the Henkel Corporation as Versamid 140CE, while the modified aliphatic amine employed may, for example, be that commercially sold by Henkel Corporation as Versamine 643CE. The amine resin employed may be any resin that is compatible to the amine resin activator. For example, where the Henkel Corporation Versamid 140CE and Versamine 643CE resin activators are employed in the first component of the sealing composition, the resin employed in the second component may be that sold as Epon 828 by the Shell Chemical Company and distributed by Chemcentral, located in Los Angeles, Calif.

The same resin activators and resins are employed to formulate the composition of the invention for use as a surface sealant. In the formulation of the underwater sealant composition of the invention for use as a surface sealant, the amine resin activator is preferably a mixture of between about 15 percent to 50 percent of a modified amine or modified aliphatic amine and about 50 percent to 85 percent accelerated amine resin. The preferred proportions are 30 percent modified amine or modified aliphatic amine and 70 percent accelerated amine resin.

Whatever the specific formulation employed, the underwater sealant composition of the invention has certain very important properties. It is designed to be water soluble when subjected to abrasion during the pot life of the material. The pot life is preferably about one hour, but may be varied depending upon the specific formulation utilized. This slight water solubility during its pot life provides the sealant composition of the invention with several important advantages over conventional swimming pool crack sealants. Due to its slight water solubility before it sets up, it may be cleaned from the apparatus of the invention using only water under pressure and without solvents as long as cleaning is performed during the pot life of the material. This facilitates the clean-up operation considerably since water under pressure can be forced through the apparatus of the invention to clean the delivery line, and since the sealant composition can be cleaned with water from the interior parts of the sealant reservoir as long as cleaning is performed during the material pot life.

Another advantage of the slight water solubility of the material during application is that as it is forced through the crack and against the walls forming the crack in the concrete, it absorbs the film of water on the adjacent concrete walls so as to form a superior chemical and mechanical bond with the adjacent concrete walls bounding the crack. This bond allows the underwater sealant to serve as a superior crack repair which is not likely to loosen and which will remain in place for long periods of time.

Another advantage of the slight water solubility of the sealant composition during its pot life is that the excess material that sometimes is extruded from the cracks and which protrudes above the exposed surface of the concrete in which the crack is formed can be scrubbed away. Thus, all of the remaining sealant composition resides between the facing adjacent surfaces of the concrete forming the crack. When the composition hardens it is therefore not subject to being dislodged by forces acting on any portions of the sealant composition protruding from the cracks.

Another very significant advantage of the underwater sealant composition of the invention is that it forms a much stronger bond with the concrete walls in which the crack is formed, as contrasted with conventional sealants. The sealant composition of the invention forms both a chemical and a mechanical bond with the concrete surfaces between which it extends.

Still another advantage of the sealant composition of the invention is that following extrusion it expands upon itself slightly. As a result, the sealant composition avoids becoming diluted in the water, and also spreads to force water and loose debris out from the crack as it expands.

Still another advantage of the sealant composition of the invention is that its components readily mix with coloring agents that permit the composition to be color matched to the surface of the concrete in which the cracks appear. When it hardens, the uncolored underwater sealant composition of the invention has the cosmetic look of white plaster. The active components of the underwater sealant composition of the invention readily accept conventional coloring fillers mixed with compatible amine resins, such as those described herein.

Another important aspect of the invention is a method of sealing a crack underwater in a concrete structure. The procedure according to the method of the invention involves utilization of a hardenable sealant composition, a sealant reservoir, a delivery hose connected to the sealant reservoir, a manually operated metering valve connected to the delivery hose, and a hollow injection needle connected to the metering valve. The steps of the method involve drilling a plurality of holes into the concrete structure at separated intervals along the length of the crack, inserting the injection needle into each of the holes, and extruding the hardenable sealable composition from the sealant reservoir, through the delivery hose, the manually operated metering valve, and the hollow injection needle into the bottom of each of the holes. As the sealant composition is extruded into the holes it displaces water and debris from the crack. The sealant composition substantially fills the crack and establishes both a mechanical and chemical bond with the walls of the crack. During its pot life the sealant composition is very slightly water absorbent, so that it absorbs the film of water on the walls of the crack as it sets up. Once the sealant composition hardens, it is impervious to water.

The size of the hollow injection needle will vary depending upon whether the sealant composition employed has a high or low viscosity. High viscosity sealant is employed to repair cracks of 1/16 of an inch and larger, while low viscosity sealant is employed to repair narrower cracks. When the sealant composition is formulated with a high viscosity, the hollow injection needle employed preferably has an outer diameter of 1/4 or 3/8 of an inch and an inner diameter of 3/16 or 5/16 of an inch. The wall thickness of the needle should be minimized to facilitate the drilling operation. Each hole is bored in the concrete to a depth sufficient to accommodate a sleeve about the needle if the crack is narrower than 1/16 of an inch or about half way to the depth of the crack if it is 1/16 of an inch or wider.

For narrow cracks of less than 1/16 of an inch in width the diameter of the hole bored is preferably large enough to accommodate a hollow, annular, tubular plastic sleeve or port that is inserted into the bore. The inner diameter of the sleeve is just large enough to admit the hollow injection needle. When a sleeve is used it is inserted into the bore following drilling and serves as a liner. The needle is then inserted into the sleeve and extends to the bottom of the bore. As the low viscosity hardenable sealant composition is extruded, the plastic sleeve surrounding the needle prevents the sealant composition from rising back up along the outer surface of the needle, but instead forces the sealant composition to pass laterally into the crack in the concrete, preferably starting at the middle of the crack. The sleeve thereby aids in directing the sealant composition into the crack.

Once the entire crack has been filled with sealant any portions of the sleeves protruding above the surface of the concrete in which the crack appears are removed with a chisel, sanded off and the central axial opening of the sleeve is filled with sealant composition.

For cracks of 1/16 of an inch or wider where the sealant composition is formulated to have greater viscosity the use of sleeves is unnecessary. In these situations the diameter of the bore is formed to snugly receive the hollow needle.

When the sealant composition is sufficiently viscous, no surface sealant is required on the underwater surface of the concrete in which the crack appears. Rather, the viscous sealant composition begins to set up somewhat as it is forced by the pressurized air supply from the depth of the crack into which it is injected. When the viscous sealant composition reaches the surface of the concrete in which the crack appears it has normally coagulated sufficiently as to form a semi-solid caulking at the surface of the concrete in which the crack appears. This partial solidification forces the more liquid portion of the sealant composition emanating from the needle to travel beneath the caulking further along the crack until the crack has been filled throughout its length with the sealant composition of the invention. Once the sealant composition has spread through the crack at least half way to the next bore, the metering valve is shut off. The needle is then removed from the bore and inserted into the next sequential bore along the length of the crack.

For cracks having a width less than 1/16 of an inch a less viscous formulation of the sealant composition of the invention is desirable due to the narrow width of the gap between the walls of the crack through which the sealant composition must be forced. Since the sealant composition utilized to repair narrower cracks has a lower viscosity, the procedure of the invention additionally involves preparing the surface of concrete in which the crack appears with a sealant composition formulated as a surface sealant. The preferred formulations of the sealant composition utilized as a surface sealant have previously been described.

In the repair of narrower cracks using an underwater sealant composition having a lower viscosity, the exposed surface in which the crack appears is treated with a quantity of the sealant composition formulated as a surface sealant. The surface sealant has a relatively high viscosity, but is still pliable enough to be spread in a band throughout the length of the crack that appears in the exposed underwater surface of the concrete. The surface sealant serves as a barrier to prevent the low viscosity sealant composition from emanating from the crack very close to the sites of injection. The surface sealant thereby forces the low viscosity sealant composition to remain in the crack, so that as the low viscosity sealant composition is injected, it spreads along the entire length of the crack, from top to bottom, and is confined therein by the band of surface sealant on the exposed surface of the concrete in which the crack appears.

The procedure for repairing narrower cracks of less than 1/16 of an inch is quite similar to the procedure for repairing cracks having a greater width. The needle employed in injecting a low viscosity sealant composition according to the invention preferably has an inner diameter of 1/8 of an inch and an outer diameter of 3/16 of an inch. Also, a plastic sleeve or port is used as an annular, tubular liner in the bores in the concrete into which the low viscosity sealant composition is injected.

The invention may be described with greater clarity and particularity by reference to the accompanying drawings.

DESCRIPTION OF THE EMBODIMENT AND IMPLEMENTATION OF THE METHOD

Figure 1:
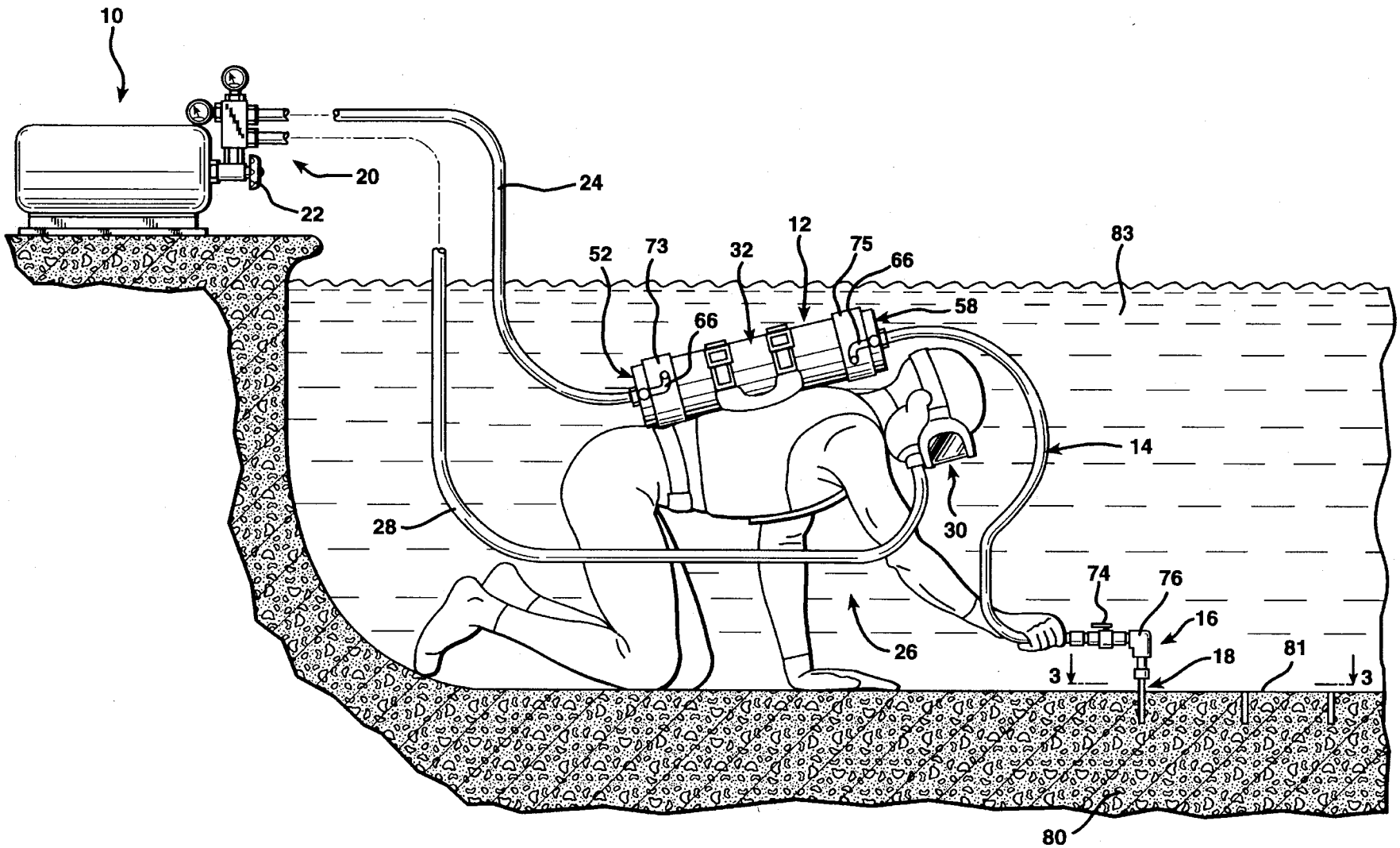
FIG. 1 is a side elevational view illustrating the apparatus and the practice of the method of the invention.
Figure 2:
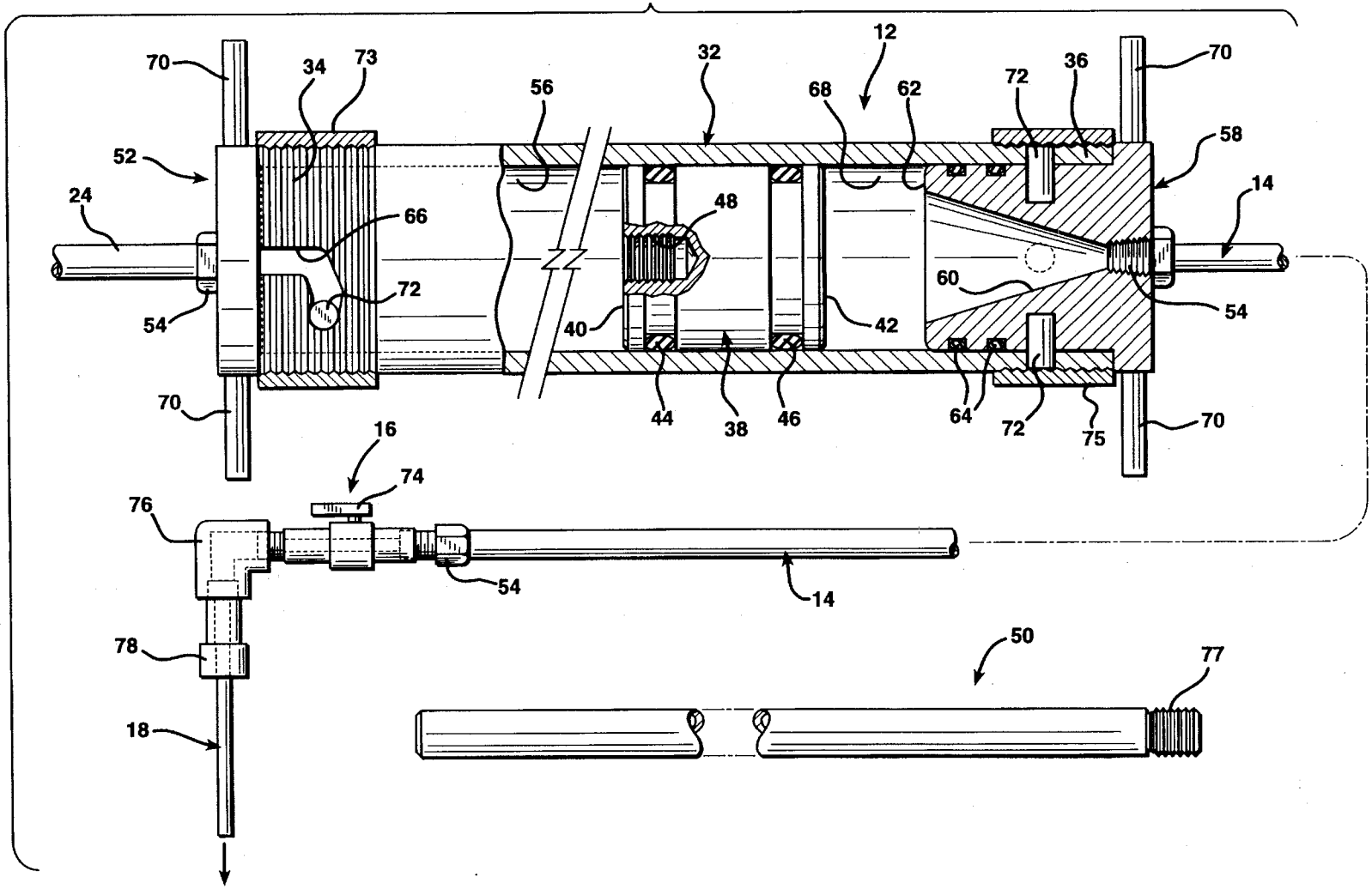
FIG. 2 is a side elevational view, shown partially in section, illustrating the apparatus of the invention in greater detail.

FIGS. 1 and 2 best illustrate the apparatus of the invention. The apparatus includes a pneumatic compressed air supply tank 10, a sealant reservoir 12, a flexible delivery hose 14, a manually operable metering valve assembly 16, and a hollow injection needle 18.

The pneumatic tank 10 may be a conventional, hollow steel pneumatic tank into which air is supplied by a compressor (not shown). The pneumatic tank 10 provides a source of air under pressure and has a regulator 20 connected to its outlet. The pneumatic pressure applied to the sealant reservoir 12 is between about 750 and 3000 pounds per square inch. The required pressure increases with the viscosity of the sealant composition employed. The regulator 20 includes a valve 22 which can be utilized to adjust the pressure supplied to the sealant reservoir through a flexible, pneumatic hose 24.

The same pneumatic pressure tank 10 can also be used to supply air to a diver, indicated generally at 26. The diver 26 receives air for breathing at a reduced pressure from a different valve in the regulator 20 through a second flexible air hose 28 that is coupled to the regulator of an air mask 30. Alternatively, the diver 26 can be provided with a self contained underwater breathing apparatus.

The sealant reservoir 12 is depicted in detail in FIG. 2. The sealant reservoir 12 is formed with a cylindrical, stainless steel barrel 32 having open, opposing, delivery and pressure application ends 34 and 36, respectively. The barrel 32 preferably has an inner diameter of about 2.5 inches and an overall length of 15 inches and is able to withstand the high pneumatic pressure which is supplied by the pneumatic pressure tank 10. The sealant reservoir 12 also includes a solid generally cylindrical piston 38 having a pressurized fluid end face 40 and an opposite sealant composition end face 42. The piston 38 is formed with an annular, radially disposed channel in its outer cylindrical wall near each of its opposite end faces 40 and 42. The channels are adapted to receive and entrap the O-rings 44 and 46 which move in sliding, fluid tight sealed engagement against the inner cylindrical wall of the barrel 32.

The piston 38 is provided with an axial tapped well 48 that extends into the pressurized fluid end face 40. The blind well 48 is threaded so as to releasably engage an elongated extractor rod 50. The extractor rod 50 has at least one externally threaded end 77 having a thread pitch and diameter adapted to engage the tapped well 48 in the piston 38. The extractor rod 50 is preferably about sixteen inches in length and is used to extract the piston 38 from the barrel 32 following expulsion of the charge of sealant composition from the sealant reservoir 12.

The sealant reservoir 12 is also formed with a pressure application end plug 52 that is removably secured to the pressure application end 34 of the barrel in fluid tight engagement therewith. The pressure application end plug 52 has an axial duct therethrough adapted to receive a conventional quick disconnect fitting 54 on the end of the pneumatic air supply hose 24 coupled thereto and to convey air under pressure into the pneumatic cavity 56 defined within the barrel 32 between the pressure application end plug 52 and the pressurized fluid end face 40 of the piston 38. Air in the pneumatic cavity 56 is at an elevated pressure and bears against the pressurized fluid end face 40 of the piston 38.

The sealant reservoir 12 is also comprised of a sealant composition delivery end plug 58 that is removably secured to the delivery end 36 of the barrel 32 in fluid tight engagement therewith. The face 42 of the piston 38 and the inwardly facing surface .62 of the composition delivery end plug 58 define therebetween a sealant composition cavity 68 within the barrel 32. The sealant composition delivery end plug 58 has a central, axial extrusion orifice therein, having a nominal diameter of about ½ inch and configured to releasably engage a conventional quick disconnect fitting 54.

The sealant composition delivery end plug 58 has an axial, frustoconical passage-way 60 that slopes radially outwardly from the extrusion orifice toward the piston 38. The opening of the frustoconical passageway 60 at the inner face 62 of the sealant composition delivery end plug 58 that is directed toward the piston 38 is preferably about 1.75 inches in diameter. The overall length of the sealant composition delivery end plug 58 is preferably about 2.92 inches.

Both of the end plugs 52 and 58 are provided with a pair of radial channels on their outer surfaces facing the inner wall of the barrel 32 to accommodate sets of rubber O-rings 64 therewithin. The O-rings 64 thereby ensure a pressure tight and fluid tight seal between both of the end plugs 52 and 58 when they are inserted respectively into the ends 34 and 36 of the barrel 32.

The sealant reservoir 12 is equipped with camlock connectors at both ends 34 and 36 of the barrel 32 for releasably locking the respective end plugs 52 and 58 to the opposite ends of the barrel 32. At each of its opposite ends 34 and 36 the barrel 32 is provided with a pair of diametrically opposite, J-shaped camlock channels or grooves 66 defined entirely through the wall structure of the barrel 32. That is, the cam lock grooves 66 extend longitudinally from both opposite extremities of the barrel 32 on diametrically opposite sides thereof. The channels then extend first at an acute angle, and then an obtuse angle on the barrel wall relative to an elevational projection of the barrel axis, as is evident from FIG. 2.

Both of the end plugs 52 and 58 are provided with diametrically opposed, radially outwardly projecting camlock pins 72. The camlock pins 72 are ⅜ of an inch in diameter and are press fitted into radial bores defined in each of the plugs 52 and 58. The pins 72 extend radially outwardly a distance of 0.18 inches from the surfaces of the end plugs that radially face the wall of the barrel 32. The pairs of radially outwardly projecting camlock pins 72 in each of the end plugs 52 and 58 are engageable in the camlock grooves 66 to releasably secure the plugs 52 and 58 to the barrel ends 34 and 36, respectively. The O-rings 64 ensure a fluid tight and pressure tight seal between the end plugs 52 and 58 and the cavities 56 and 68 defined on the opposite sides of the piston 38 within the barrel 32.

The outer wall of the barrel 32 is externally threaded at both of the ends 34 and 36 to receive cylindrical annular, internally threaded reinforcing sleeves 73 and 75, respectively. The sleeves 73 and 75 are threadably engaged at the barrel ends 34 and 36, respectively, on the outer wall thereof and in longitudinal alignment with the camlock grooves 66. The reinforcing sleeves 73 and 75 are each about 1.5 inches in length and serve to radially reinforce the barrel ends 34 and 36 about the camlock grooves 66.

Each of the end plugs 52 and 58 is provided with a pair of radially projecting torquing hand grip rods 70 by means of which the end plugs 52 and 58 can be rotated and counterrotated about the axis of the barrel 32. The end plugs 52 and 58 can thereby be releasably locked and unlocked by engagement and disengagement of the camlock pin 72 in the camlock grooves 66.

The inner diameter of the material delivery hose 14 is preferably about 3/16 of an inch. The delivery hose 14 is formed with a Teflon inner liner externally reinforced with stainless steel braiding. The delivery hose 14 is equipped at both ends with conventional threaded fittings 54.

The end of the hose 14 remote from the sealant reservoir 12 is connected to the manually operable metering valve assembly 16. The valve assembly 16 is provided with a ball valve which may be selectively opened and closed to the extent desired by means of a valve handle 74. The metering valve assembly 16 also has a ninety degree elbow 76 and a socket 78 for receiving the hollow delivery injection needle 18 therein. The needle 18 is also formed of stainless steel and varies in diameter, depending upon the viscosity of the underwater sealant composition employed.

In repairing a crack under water in the concrete floor 80 of a swimming pool according to the method of the invention, the diver 26 first inspects the physical size and length of the crack to be repaired. A typical crack 82 as it appears on the surface 81 of a swimming pool floor 80 is depicted in the plan view of FIG. 3.

When use of a low viscosity formulation of the sealing composition of the invention for extrusion into the crack 82 is indicated, such as when the crack 82 is less than 1/16 of an inch in width, a quantity of the composition of the invention formulated for use as a surface sealant is applied. The surface sealant is pressed onto the surface 81 in a strip indicated in phantom at 86 in FIG. 3. The strip 86 is laid along the length of the crack 82 where the crack 82 appears in the underwater surface 81 of the concrete swimming pool floor 80.

The strip 86 of hardenable sealant composition applied on the surface 81 so as to span the crack 82 is preferably formulated of the first and second components previously described in the following formulations. A first component is mixed with a proportion of 1000 parts by weight of an amine resin accelerator, 1500 parts by weight white cement, and 2900 parts by weight underwater cement. The white cement employed may be that manufactured by Lehigh Cement Co. in Waco, Tex., while the underwater cement may be that sold as Pool Patch by Premixed Products located in Irwindale, Calif. While greater or lesser quantities of these materials may be employed, depending upon the length of the crack 82, the proportions of constituents are preferably as indicted herein.

The resin activator employed is preferably a composite of 30 percent modified amine or modified aliphatic amine and 70 percent accelerated amine resin. The second component is mixed with 1000 parts by weight of an amine resin, 1400 parts by weight white cement, and 2750 parts by weight underwater cement. The amine resin may be any appropriate epoxy resin compatible with the activator in the first component. In the example indicated Epon 828, manufactured by the Shell Chemical Company, may serve as the amine resin in the second component.

The first and second components of the surface sealant composition are then mixed together in a range of between equal parts of the first and second composition components, and two parts of the second component for each part of the first.

Figure 3:
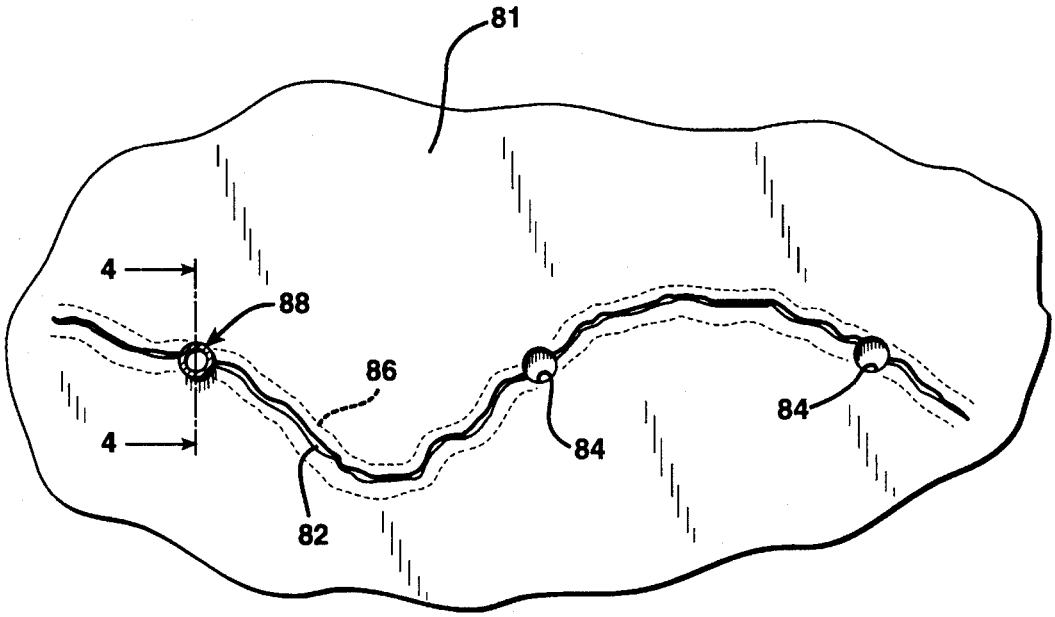
FIG. 3 is a top plan detail taken along the lines 3—3 of FIG. 1 and showing a crack narrower than 1/16 of an inch in width.
Figure 4:
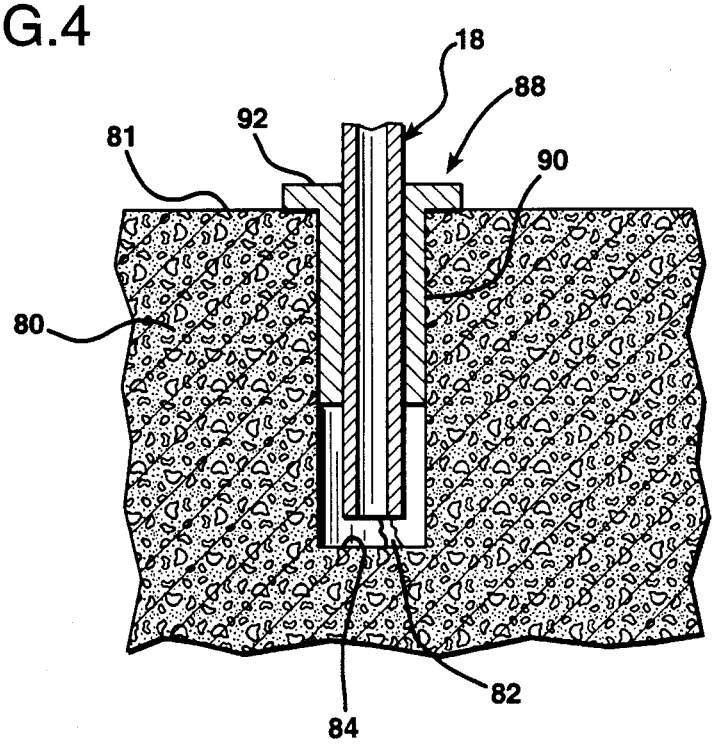
FIG. 4 is a sectional elevational detail taken along the lines 4—4 of FIG. 3.

Once the surface sealant composition components have been mixed, the resulting surface sealant material must be promptly applied in a strip 86 along the length of the crack 82 following the path indicated in FIG. 3. The surface sealant composition will begin to set up, thereby forming a barrier to the low viscosity sealant composition to be injected into the crack 82.

The width of the crack 82 determines the viscosity of the formulation of the sealant composition of the invention appropriate for use in the repair process. Once this is determined a hollow sealant injection needle 18 of suitable diameter is selected. The diameter of the needle and the viscosity of the sealant composition to be used determine the appropriate diameter of the holes to be drilled in the swimming pool floor 80.

The diver 26 first utilizes a conventional underwater power drill to drill a series of bores 84. For example holes of about three eighths of an inch in diameter may be drilled at separated intervals from four to twelve inches apart along the length of the crack 82. The wider the crack 82 the greater will be the distance between the bores 84.

The holes are drilled to a depth about half the depth of the crack 82 in the concrete floor 80. Once the holes 84 have been drilled, hollow, annular plastic sleeves or ports 88 are inserted into each of the holes 84 where use of a sealant composition formulation having a low viscosity is indicated. Each sleeve 88 has a cylindrical, tubular portion 90 and a radially extending upper flange 92 at its upper extremity. The sleeves 88 can be pounded into the holes 84 if necessary until the flanges 92 are fully seated against the upper surface 81 of the concrete floor 80 of the swimming pool. The tubular portions 90 of the sleeves 88 preferably extend about one and one half inches below the surface 81.

The quantity of the underwater sealant composition to be utilized and which will fill the crack 82 completely must then be determined. With the end plugs 52 and 58 removed from the sealant reservoir 12, the piston 38 is first longitudinally positioned within the barrel 32 so as to define a sealant composition cavity 68 of appropriate volume.

For a typical narrow crack 82 less than 1/16 of an inch in width the first component of the charge of underwater sealant composition is preferably formed with about 1000 parts by weight of an amine resin activator, about 625 parts by weight white cement, and about 1250 parts by weight underwater cement. The amine resin activator in the first component is preferably formed of about 1/6 polyamide resin or modified amine resin and about 5/6 accelerated amine resin measured by weight.

The second component of the low viscosity sealant composition of the invention is preferably formed of 1000 parts by weight of an amine resin, 625 parts by weight white cement, and 1250 parts by weight underwater cement. The amine resin employed in the second component may be formed of any amine resin compatible with the activator of the first component. For example, Shell Epon 828 resin may be utilized as the amine resin in the second component, while the polyamine resin activator in the first component may be formed of a mixture of Versamid 14CE polyamide amines and Versamine 643CE modified aliphatic amines, both manufactured by Hinkel Corporation and mixed in the proportions indicated. The white cement and the underwater cement may be the same as those utilized in preparing the surface sealant.

In formulating the sealant composition to be extruded into the crack 82, coloring agents may be added to the first and second components of the sealant composition to match the color of that composition to the color of the surface 81 of the swimming pool floor 80. In the absence of coloring agent, the sealant composition of the invention has a white color and resembles plaster in texture.

The first and second components of the sealant composition of the invention to be extruded from the sealant reservoir 12 are premixed and stored separately prior to use. Once the holes 84 have been drilled and the strip 86 of surface sealant applied to cover the length of the crack 82, quantities of the first and second components of the low viscosity sealant composition are then mixed in equal parts. The mixture is then placed in the sealant composition cavity 68 of the sealant reservoir 12.

The end plugs 52 and 58 are then inserted respectively into the ends 34 and 36 of the sealant reservoir barrel 32. The torquing handles 70 are then twisted so as to fully engage the camlock pins 72 of both of the plugs 52 and 58 in the camlock grooves 66 defined at the opposite ends of the barrel 32. The O-rings 64 on the plugs 52 and 58 thereupon provide pressure tight and fluid tight seals at the ends 34 and 36 of the sealant reservoir barrel 32.

The quick disconnect coupling 54 of the pneumatic hose 24 is then engaged in the axial duct of the pressure application end plug 52. The threaded couplings 54 at both ends of the delivery hose 14 are respectively engaged in the extrusion orifice of the sealant composition delivery end plug 58 and the coupling socket of the metering valve assembly 16. The valve handle 22 of the pressure regulator 20 is then opened to permit air under pressure from the pressurized tank 10 to act through the pneumatic hose 24 and pressurize the pneumatic cavity 56 of the sealant reservoir 12.

The diver 26 then enters the water 83 and begins to extrude the hardenable sealant composition into each of the holes 84. This is done by inserting the hollow delivery needle 18 into each of the sleeves 88 and manipulating the ball valve lever 74 so as to allow the pneumatic pressure in the pneumatic cavity 56 to force the sealant composition from the sealant cavity 68, through the frustoconical passageway 60, out through the extrusion orifice in the sealant composition delivery end plug 58 and into the delivery hose 14. From the delivery hose 14 the sealant composition travels through the ball valve in the metering valve assembly 16, through the elbow 76, and through the axial passageway of the needle 18. The sealant composition enters each hole 84 beneath the plastic tubular portion 90 of each sleeve 88. Since the needle 18 fits snugly into the sleeve 88, the sealant composition is blocked from traveling back up along the outside of the needle 18, and instead is forced laterally into the crack 82 defined in the concrete swimming pool floor 80.

Since the strip 86 of surface sealant extends along the entire length of the crack 82, the low viscosity sealant composition cannot emanate upwardly out of the crack 82 from the upper surface 81 of the concrete swimming pool floor 80. Rather, the pneumatic pressure provided from the pneumatic tank 10 causes the sealant composition to permeate the crack 82 to at least half the distance of travel to the adjacent holes 84.

At this point the diver 26 then operates the ball valve lever 74 to close the ball valve of the metering valve assembly 16. The metering valve assembly 16 is then lifted to withdraw the needle 18 from the sleeve 88, and the needle 18 is then moved to the next sequential hole 84. The needle 18 is again inserted into the sleeve 88 of the next sequential hole 84 and the valve lever 74 is again operated to open the ball valve of the metering valve assembly 16. This permits the pressure from the pressurized tank 10 to force additional sealant composition from the sealant composition cavity 68 of the sealant reservoir 12, through the hose 14, through the metering valve assembly 16, and out through the needle 18 in the manner previously described. The process is repeated until the entire crack 82 has been filled with sealant composition, throughout its length, width and depth.

The sealant composition of the invention is such that it displaces water and debris from the crack 82 and fills the crack 82 completely. The sealant composition of the invention is very slightly water absorbent during its pot life, so that the water on the edges of the concrete structure in which the crack 82 is defined is absorbed. The sealant composition thereby forms a very strong mechanical and chemical bond within the concrete swimming pool floor 80.

The sealant composition of the invention has a pot life of a maximum of about one hour. Therefore, the task of extruding the hardenable sealant composition into the holes 84 should be completed well within the pot life of the composition.

Once sealant has been extruded into the crack 82 through all of the holes 84, a chisel is normally employed to sever the collar flanges 92 from the tubular portions 90 of the sleeves 88. The central axial openings in the remaining tubular portions 90 of the sleeves 88 are then filled with the sealant composition by inserting only the extreme tip of the needle 18 therein and by operating the ball valve lever 74.

Once the crack 82 and holes 84 have been filed completely, the residual sealant composition must be promptly cleaned from the apparatus of the invention. To effectuate cleaning the pneumatic valve handle 22 is first operated to close the valve of the regulator 20 so that the sealant reservoir 12 is no longer under pressure. The torquing handles 70 of the end plugs 52 and 58 are then counterrotated to disengage the camlock pins 72 from the camlock grooves 66. The end plugs 52 are then removed and the threaded end 77 of the extraction rod 50 is engaged in the tapped well 48 of the piston 38. The extraction rod 50 is used to pull piston 38 all the way out of the end 34 of the barrel 32. Any residual sealant composition is then wiped from the inside of the barrel 32, from the sealant composition end face 42 of the piston 38, and from the face 62 and passageway 60 of the sealant composition end plug 58. Since the sealant composition is slightly water soluble during its pot life, it can be removed relatively easily from the component parts of the sealant reservoir 12 as long as the apparatus is cleaned before the sealant composition sets up.

Once the sealant reservoir 12 has been cleaned of any residual sealant composition, the end plug 52 is then inserted into the end 36 of the barrel 32 and reengaged by its camlock pins 72. The barrel 32 is turned to a vertical position with the end 36 down and is then filled with water. The end plug 58 is then reengaged. The valve handle 22 of the regulator 20 is then manipulated to open the valve, whereupon pneumatic pressure is applied directly to the water in the barrel 32 due to air pressure transmitted through the pneumatic hose 24.

The ball valve handle 74 of the metering valve assembly 16 is then fully opened. This allows the pneumatic pressure within the barrel 32 to force the water from the barrel 32 to flush out the system. The water within the barrel 32 is expelled through the delivery hose 14, the metering valve assembly 16, and the needle 18. Since the sealant composition theretofore remaining in the hose 14, metering valve assembly 16, and needle 18 is still slightly soluble in water during its pot life, all of the residual sealant composition in the system can be flushed out of these apparatus components without the use of any solvents. The entire apparatus of the invention is thereupon again available for use to extrude additional charges of sealant composition to repair cracks in underwater concrete.

The repair of a crack 82 having a width of 1/16 of an inch or greater is performed in a similar manner as described for repairing a crack less than 1/16 of an inch in width. One difference in the process is that for cracks 1/16 of an inch or greater, the proportions of the constituents of the components in the sealing composition of the invention are altered to produce a sealant composition of higher viscosity. Also, it is unnecessary to apply a strip 86 of surface sealant on the concrete surface 81 over the crack 82 where it appears therein. In addition, sleeves 88 are not necessary, so a hollow injection needle 18 is selected which will fit snugly against the walls of the bores 84 when inserted therein.

In the preferred practice of the invention to repair a crack 82 greater than 1/16 of an inch in width, the same substances are used to create the first and second components of a sealant composition, but the proportions of the constituent substances are varied from that utilized to produce a low viscosity sealant composition. Specifically, the preferred formulation of the first component of a high viscosity sealant composition utilized according to the invention employs 1000 parts of an amine resin activator, 1440 parts white cement and 2880 parts underwater cement. The second component of such a composition is formed of 1000 parts of an amine resin, 1360 parts white cement and 2720 parts underwater cement.

The present invention provides a unique system for repairing underwater cracks in concrete. The apparatus employed is particularly useful with the sealant composition of the invention, since it can be utilized to quickly and effectively deliver the sealant composition deep into cracks in underwater concrete through a conduit from a portable sealant reservoir. Also, the apparatus is such that it can be readily cleaned without the use of solvents. The sealant composition of the invention bonds readily to the facing concrete walls in which the crack is formed and expands slightly so as to avoid dilution in the water and so as to force the water and loose debris from the crack. The sealant composition is capable of curing under water and absorbs the film of water on the surfaces of the concrete forming the faces of the crack to achieve a high strength, mechanical and chemical bond. Also, the sealant composition may be color matched to many different colored surfaces. The process of the invention allows the sealant composition to be delivered deep into a crack to be repaired and in such a manner as to fill the crack entirely throughout its length and depth with an effective sealant composition.

Undoubtedly, numerous variations and modifications of the invention will become readily apparent to those familiar with the repair of underwater cracks in concrete. The invention may be applied to many different types of underwater concrete structures, such as dams, pilings and reservoirs, and is not limited to the repair of cracks in swimming pools. Also, different variations of the formulation of the sealant composition of the invention may be utilized. Accordingly, the scope of the invention should not be construed as limited to the specific embodiments, illustrations and implementations described herein.

I claim:

1. Apparatus for delivering an underwater sealant composition comprising:

a sealant reservoir formed with a cylindrical barrel having open, opposing, delivery and pressure application ends and camlock grooves defined therein at each end thereof and wherein said outer wall of said barrel is externally threaded at both of said ends, a piston having opposite pressurized fluid and sealant composition end faces and disposed for reciprocal movement within said barrel, a pressure application end plug removably secured to said pressure application end of said barrel in fluid tight engagement therewith and having a duct therethrough to convey fluid under pressure into said barrel to bear against said pressurized fluid end face of said piston, and a sealant composition delivery end plug removably secured to said delivery end of said barrel in fluid tight engagement therewith and having an extrusion orifice therein, and wherein said plugs both have radially outwardly projecting camlock pins engageable in said camlock grooves to releasably secure said plugs to said barrel ends, annular internally threaded reinforcing sleeves threadably engaged on said outer wall of said barrel in longitudinal alignment with said camlock grooves to radially reinforce said barrel externally thereabout, a source of fluid under pressure coupled to provide fluid under pressure to said sealant reservoir through said pressure application end plug, a flexible delivery hose having one end connected to said sealant composition delivery end plug and an opposite end, a manually operable metering valve coupled to said opposite end of said delivery hose, and a hollow injection needle connected to said manually operable metering valve.

* * * * *